US006460932B1

(12) United States Patent
Kopish et al.

(10) Patent No.: US 6,460,932 B1
(45) Date of Patent: Oct. 8, 2002

(54) ARM HEIGHT ADJUSTMENT MECHANISM FOR A CHAIR

(75) Inventors: Andrew J. Kopish; Mark D. Dart, both of Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 293 days.

(21) Appl. No.: 09/591,326

(22) Filed: Jun. 9, 2000

(51) Int. Cl.[7] ..... A47C 7/54

(52) U.S. Cl. ..... 297/411.36; 297/411.35; 297/411.37; 248/118.3

(58) Field of Search ..... 297/411.36, 411.37, 297/411.35; 248/118.3, 118.1, 118

(56) References Cited

U.S. PATENT DOCUMENTS

| | | | |
|---|---|---|---|
| 3,489,458 | A | 1/1970 | Karlsen |
| 4,244,623 | A | 1/1981 | Hall et al. |
| 4,311,338 | A | 1/1982 | Moorhouse |
| 4,489,981 | A | 12/1984 | Goletski |
| 4,496,190 | A | 1/1985 | Barley |
| 4,619,478 | A | 10/1986 | Heimnick et al. |
| 4,659,135 | A | 4/1987 | Johnson |
| 4,674,790 | A | 6/1987 | Johnson |
| 4,881,424 | A | 11/1989 | Clark et al. |
| 4,951,995 | A | 8/1990 | Teppo et al. |
| 5,009,467 | A | 4/1991 | McCoy |
| 5,265,938 | A | 11/1993 | Melhuish et al. |
| 5,318,347 | A | 6/1994 | Tseng |
| 5,368,365 | A | 11/1994 | Feldberg |
| 5,382,079 | A | 1/1995 | Wilson et al. |
| 5,439,267 | A | 8/1995 | Peterson et al. |
| 5,588,766 | A | 12/1996 | Lai |

FOREIGN PATENT DOCUMENTS

| | | |
|---|---|---|
| EP | 0587537 | 3/1994 |
| WO | WO 96/39901 | 12/1996 |

(List continued on next page.)

*Primary Examiner*—Beth A. Stephan
*Assistant Examiner*—Dennis L. Dorsey
(74) *Attorney, Agent, or Firm*—Boyle, Fredrickson, Newholm, Stein & Gratz, S.C.

(57) ABSTRACT

An adjustable armrest assembly for a chair provides adjustment in both the vertical and horizontal position of an armrest member. A tubular member is adapted for telescopic mounting to an upwardly extending support member mounted to the chair. The support member includes a series of spaced teeth defining indentations therebetween. The armrest assembly includes a pivotable latch member which is secured to the tubular member utilizing a cap member mounted to the upper end of a passage defined by the tubular member. The cap member and the tubular member define cooperating mounting structure for providing pivoting movement of the latch member. The latch member is movable between an engaged position, in which the latch member is engaged with an indentation between the teeth defined by the support member, and a disengaged position in which the latch member is moved out of engagement with the teeth. The latch member includes a manually operable trigger section for moving the latch member between its engaged and disengaged positions. An armrest member includes a base section and an arm cap. The base section of the armrest member is pivotably mounted to the cap member via a fastener which both secures the base section to the cap member and defines the pivot axis about which the base section is pivotable. The cap member includes spaced indentations. A spring member is mounted to the base section, and includes a protrusion received within a selected one of the indentations for providing a click-type detent for selectively maintaining the armrest member in a predetermined angular orientation.

42 Claims, 10 Drawing Sheets

U.S. PATENT DOCUMENTS 5,599,067 A 2/1997 Schuelke et al.
5,649,741 A 7/1997 Beggs
5,664,842 A 9/1997 Tseng
5,735,577 A 4/1998 Lin
5,749,628 A 5/1998 Snyder et al.
5,752,683 A 5/1998 Novis et al.
5,765,920 A 6/1998 Lai
5,769,497 A 6/1998 Tsai
5,879,054 A 3/1999 Cao
5,895,095 A 4/1999 Chen
5,918,938 A 7/1999 Miotto
5,931,537 A 8/1999 Gollin et al.
5,971,484 A 10/1999 Lamart et al.

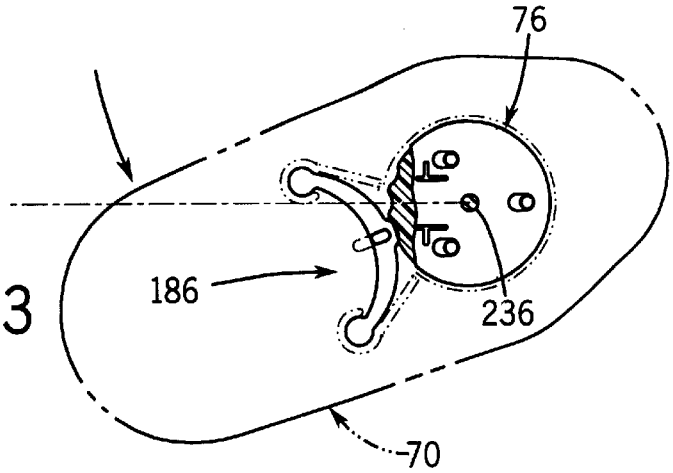
FIG. 13
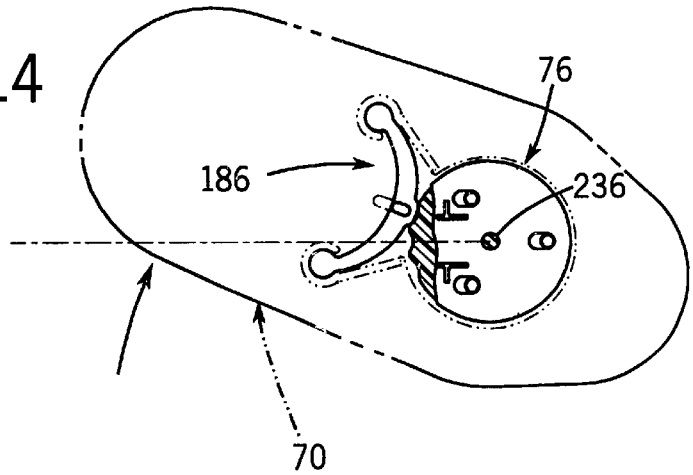
FIG. 14
FIG. 15
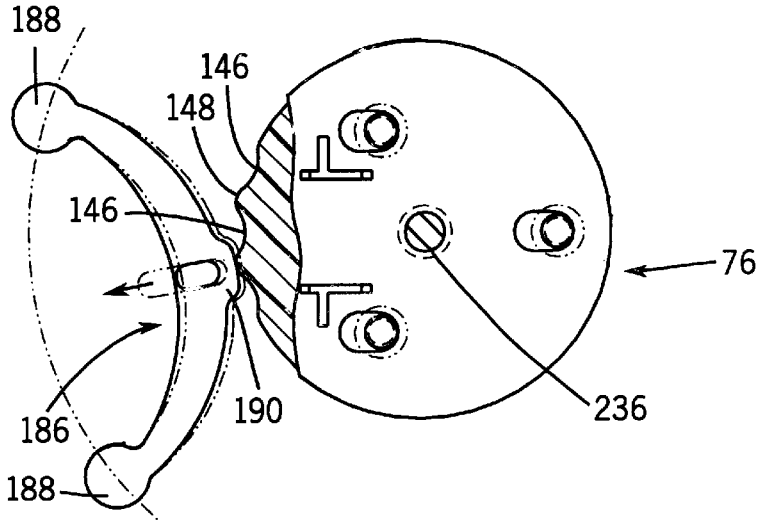

ARM HEIGHT ADJUSTMENT MECHANISM FOR A CHAIR

BACKGROUND AND SUMMARY

This invention relates to an arm assembly for a chair, and more particularly to an arm assembly including a feature providing adjustment in the height of the armrest relative to the seat of the chair.

Adjustable height armrest assemblies are known, and examples are illustrated in various prior art patents. In general, many adjustable height armrest assemblies include a support member interconnected with the seat or base of the chair and extending upwardly from the seat adjacent a side of the seat, and an armrest assembly slidably mounted to the support member. The armrest assembly typically includes an armrest member and a depending tubular member defining an internal passage within which the support member is slidably received. The tubular member telescopes relative to the support member to adjust the height of the armrest relative to the seat. A movable latch member is interconnected with the armrest assembly, and is selectively engageable with one of a series of spaced notches or the like formed in or on the support member. In some versions, the latch member includes a manually engageable trigger section which selectively moves the latch member into or out of engagement with the notches. In other versions, the latch member is internal and is engageable with an actuator arrangement for selectively moving the latch member between an engaged position and a disengaged position, depending upon the position of the armrest member relative to the support member.

It is an object of the present invention to provide an arm assembly for a chair which includes a latch member having an external trigger section for moving the latch member between an engaged position and a disengaged position. It is a further object of the invention to provide such an arm assembly which provides an improved arrangement for pivotably mounting the latch member relative to the support member. Yet another object of the invention is to provide such an arm assembly in which the armrest member is pivotable about a substantially vertical pivot axis, for adjusting the position of the armrest member in a horizontal plane. A still further object of the invention is to provide such an arm assembly having an arrangement which provides the dual function of pivotably mounting the latch member for movement between its engaged position and its disengaged position, and pivotably mounting the armrest member for movement about a substantially vertical pivot axis. Yet another object of the invention is to provide an arm assembly with an improved construction for releasably maintaining the armrest member in a selected horizontal position relative to the support member to which the armrest member is mounted. Yet another object of the invention is to provide an adjustable height armrest assembly which includes a retainer arrangement for preventing the armrest assembly from being disengaged from the support member, to which the armrest assembly is mounted for telescoping movement. Yet another object of the invention is to provide such an arm assembly having an improved construction for the latch member and its associated trigger and spring, which functions to bias the latch member toward its engaged position.

In accordance with the invention, an arm assembly for a chair having a seat and a back includes a support member which extends upwardly from the seat adjacent a side of the seat. An armrest assembly includes an armrest member and a depending tubular member which defines an internal passage within which the support member is received, for providing telescoping movement of the armrest assembly relative to the support member. The tubular member includes a series of spaced engagement areas or notches. The latch member includes an upper trigger section and a lower engagement section which is selectively engageable with the spaced engagement areas of the support member, for selectively fixing the height of the armrest member relative to the seat. The latch member is preferably mounted to the armrest assembly for pivoting movement between an engaged position in which the engagement section is engaged with one of the notches, and a disengaged position in which the engagement section is moved out of engagement with the notches. The latch member is preferably biased toward its engaged position.

The tubular member defines an upper end to which the armrest member is mounted by means of a cap member secured to the upper end of the tubular member. The cap member provides the dual function of pivotably mounting the latch member to the tubular member, and pivotably mounting the armrest member to the tubular member for movement about a substantially vertical pivot axis. The latch member includes transverse pin structure which is received within one or more arcuate recesses or seats associated with the tubular member. The cap member includes one or more mating arcuate recesses or seats which engage the pin member when the cap member is secured to the upper end of the tubular member, and the arcuate recesses or seats cooperate to pivotably mount the latch member to the tubular member. In addition, a pivotable mounting arrangement is interposed between the armrest member and the cap member for pivotably mounting the armrest member to the cap member. The pivotable mounting arrangement includes a pivot member, such as a threaded fastener, which is engaged with the armrest member and received within a passage defined by the cap member.

A detent arrangement interposed between the armrest member and the cap member for selectively maintaining the armrest member in a predetermined horizontal position relative to the tubular member. A series of laterally facing detent areas are provided on the cap member, and a resilient engagement member is mounted to the armrest member. The engagement member is selectively engageable with one of the laterally facing detent areas for releasably maintaining the armrest member in a predetermined horizontal position relative to the tubular member. The resilient engagement member may be in the form of a spring member having a pair of ends which are fixedly mounted to the armrest member, with an engagement area located between the spaced ends of the spring member. The spring member deflects as the engagement area moves between the laterally facing engagement areas, and moves the engagement area of the spring member into one of the laterally spaced detent areas when the engagement area of the spring member is aligned therewith, so as to releasably maintain the armrest member in position.

A retainer arrangement is interposed between the armrest assembly and the support member for maintaining the armrest assembly in engagement with the support member. The retainer arrangement includes a retainer member engaged with the support member and engagement structure provided on the latch member. The engagement structure is engageable with the retainer member when the tubular member is moved to a predetermined extended position relative to the support member. The support member defines a channel within which the series of spaced engagement areas are located. An engagement section of the latch member is received within the channel, and at least a portion of the retainer member overlies the channel for engagement with the engagement section of the latch member when the arm assembly is raised relative to the support member, to prevent disengagement of the arm assembly from the support member.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIGS. 13 and 14 are views similar to FIG. 12, showing movement of the armrest member to different angular positions; and FIG. 15 is a partial plan view, with portions in section, illustrating the spring member and detent areas which releasably retain the armrest member in its various angular positions.

DETAILED DESCRIPTION OF THE INVENTION

Figure 1:
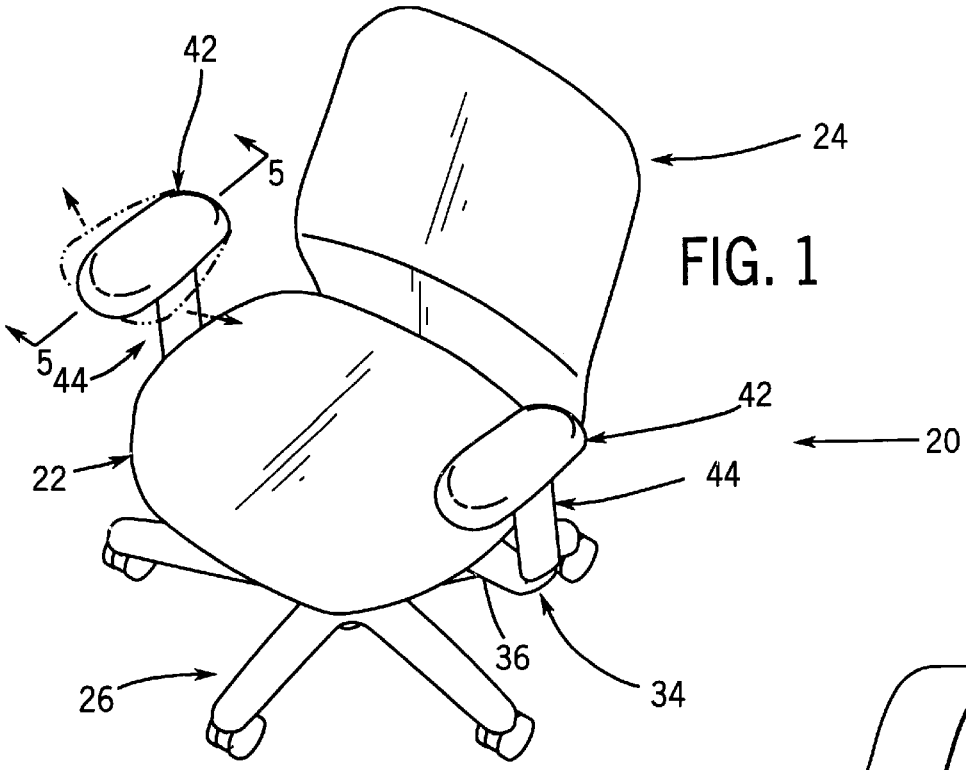
FIG. 1 is an isometric view of a chair including the adjustable height arm assembly constructed in accordance with the present invention.
Figure 2:
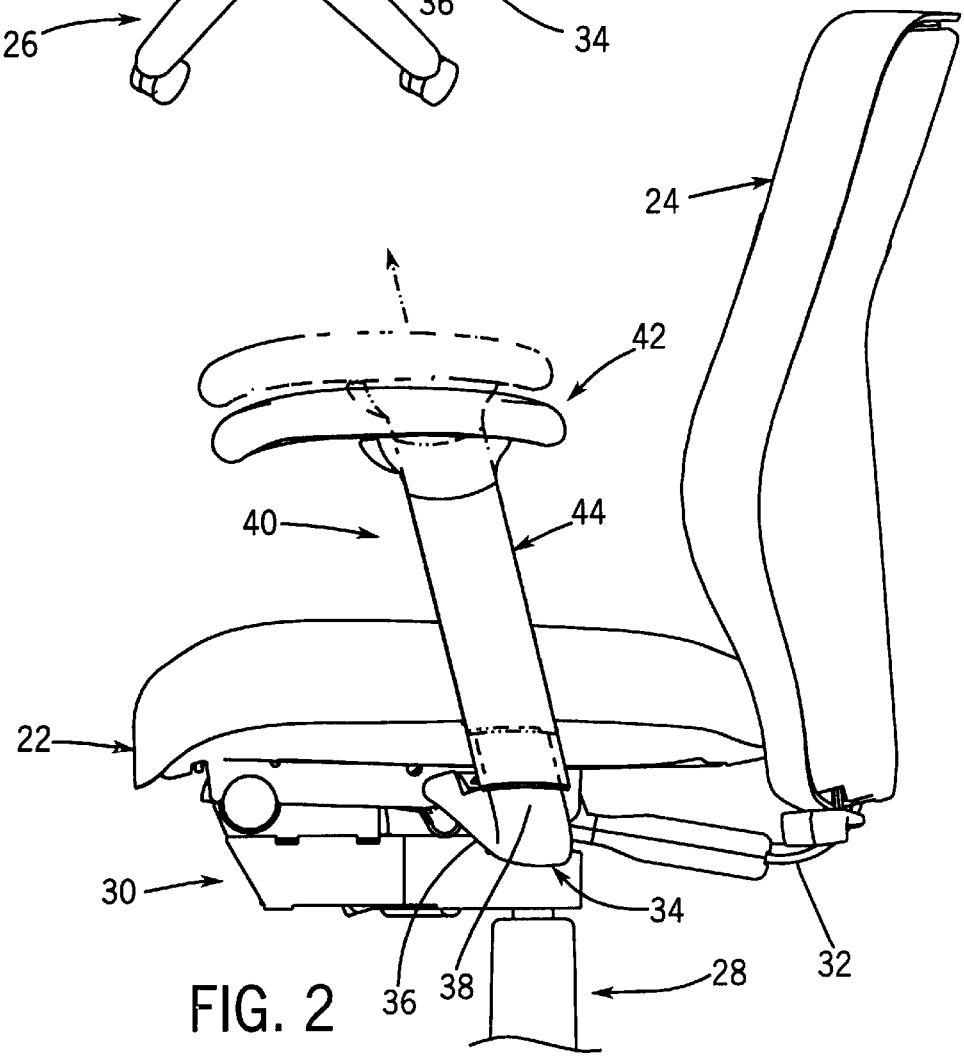
FIG. 2 is a side elevation view of the chair of FIG. 1.

Referring to FIGS. 1 and 2, a chair 20 generally includes a seat 22 and a back 24. Seat 22 is mounted to a base assembly 26, which typically includes a gas cylinder assembly 28 and a chair control mechanism 30 interposed between seat 22 and gas cylinder assembly 28. Back 24 is interconnected with control mechanism 30 via a back support member 32.

A pair of arm support members 34 are located at each side of seat 22. Each arm support member 34 includes a laterally extending mounting portion 36 and an upwardly extending support section 38 extending upwardly from mounting portion 36 and located adjacent the side of seat 22.

Figure 5:
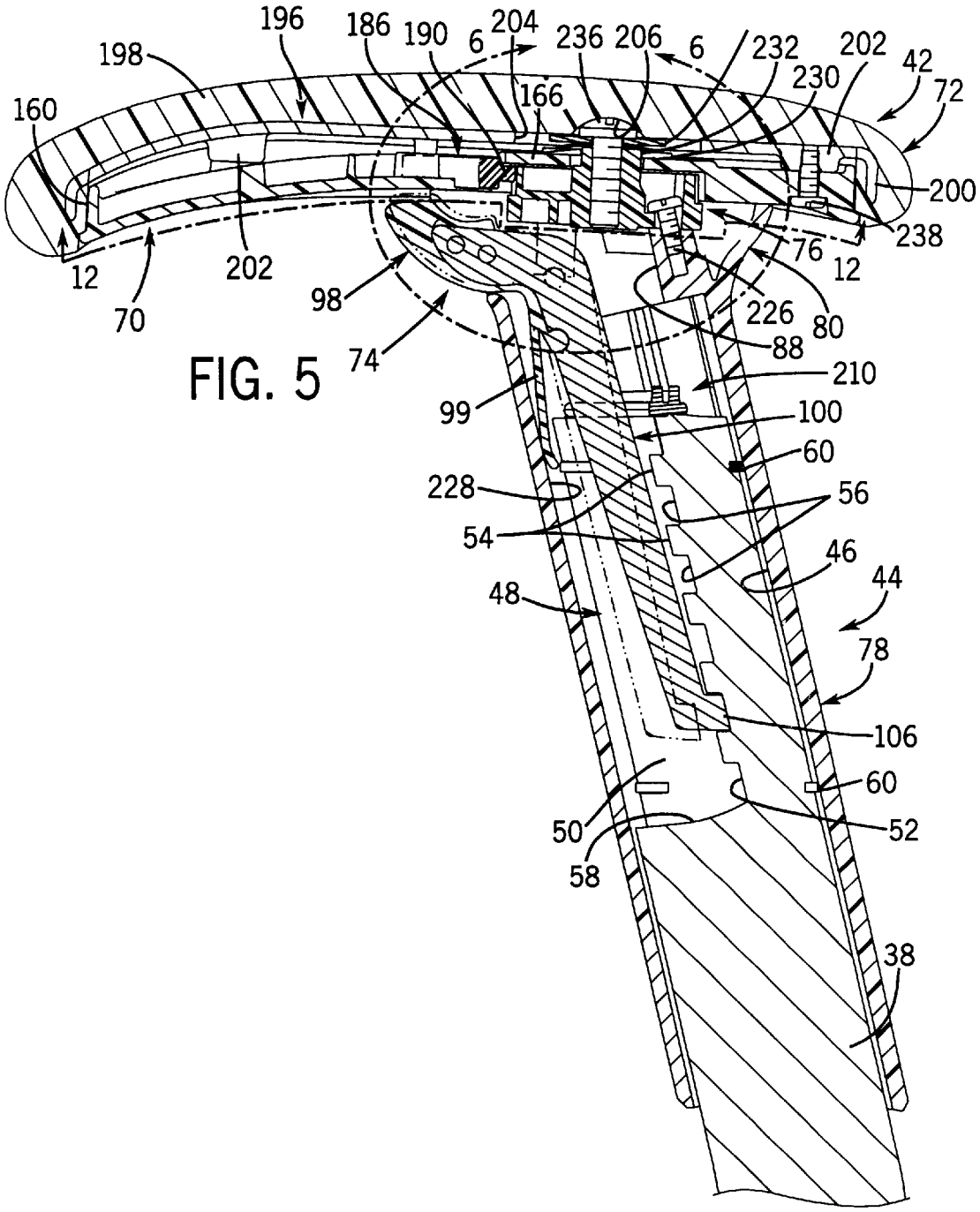
FIG. 5 is a section view taken along line 5—5 of FIG. 1.

An adjustable armrest assembly 40 is mounted to each upwardly extending support section 38. Generally, armrest assembly 40 includes an armrest member 42 and a depending tubular member 44. As shown in FIG. 5, support section 38 of each arm support member 34 is received within a downwardly open internal passage 46 defined by tubular member 44. In a manner to be explained, tubular member 44 is mounted for telescoping movement to support section 38, to adjust the height of armrest member 42.

Figure 3:
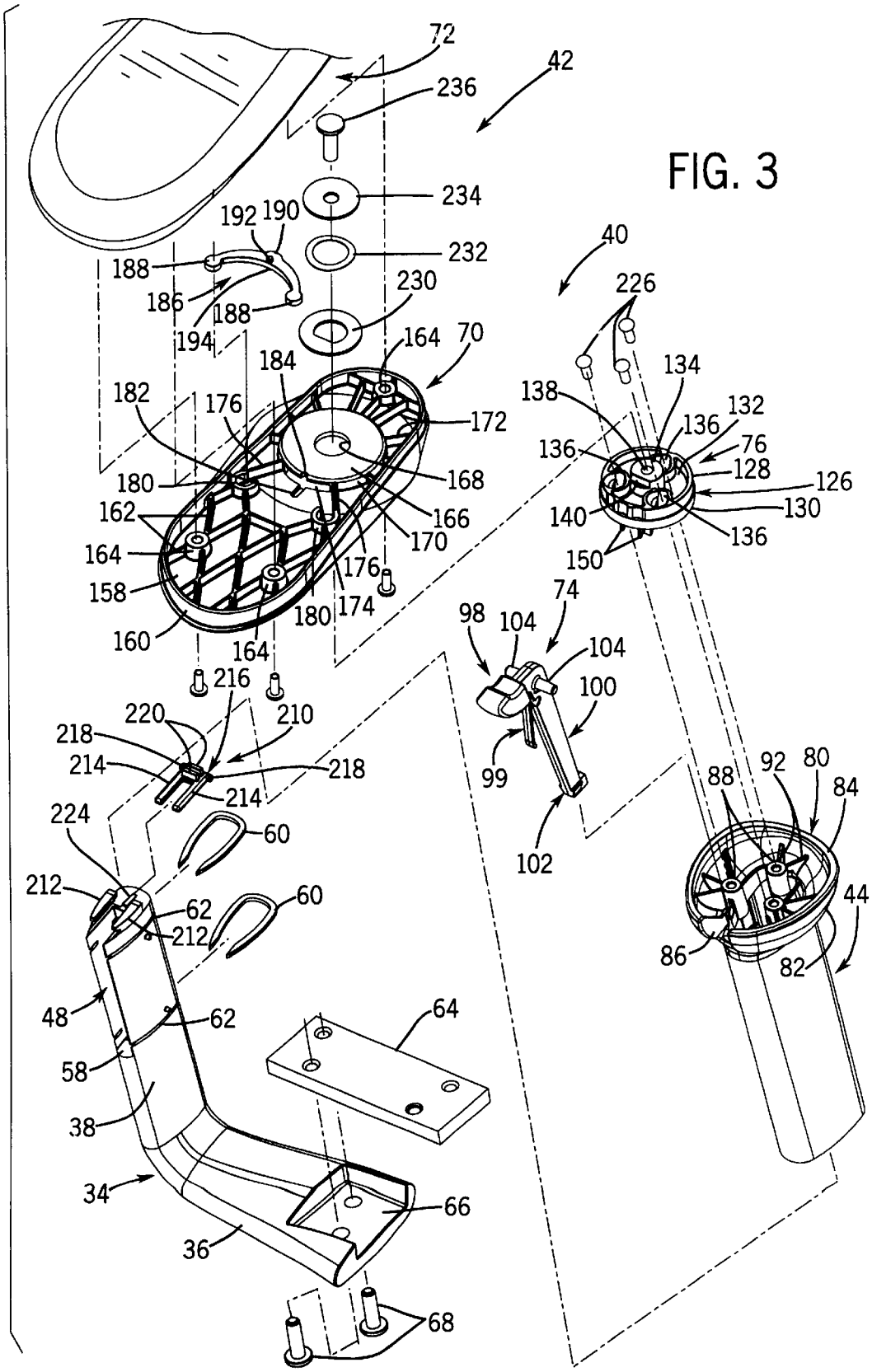
FIG. 3 is an exploded isometric view illustrating the components of the adjustable armrest assembly incorporated in the chair of FIGS. 1 and 2.

As shown in FIGS. 3 and 5, upwardly extending support section 38 of arm support member 34 defines a channel 48 toward its upper end. Channel 48 opens onto the top end of support section 38, and includes a pair of side walls 50 and an end wall 52 having a series of teeth 54 extending therefrom, which define engagement areas or indentations 56 therebetween. Side walls 50 and end wall 52 terminate in a transverse lower wall 58.

Each of a pair of U-shaped spacers 60 (FIGS. 3, 5) is engaged within one of a pair of grooves 62 formed in support section 38. Spacers 60 are formed of a low friction material such as nylon, and have a shape which corresponds to that of internal passage 46 of tubular member 44. Spacers 60 engage the inner surface of tubular member 44 which defines passage 46, for facilitating sliding movement of tubular member 44 relative to support member 38.

As shown in FIG. 3, a mounting bar 64 is engageable with the underside of seat 22, and is received within a recess 66 formed in mounting portion 36 of arm support member 34. Screws 68 extend through aligned openings in mounting portion 36 and bar 64 so as to mount arm support member 34 to seat 22.

Referring to FIG. 3, armrest member 42 of armrest assembly 40 includes a base section 70 and an arm cap 72. In addition to armrest member 42 and tubular member 44, armrest assembly 40 further includes a latch member 74 and a cap member 76. In a manner to be explained, latch member 74 and cap member 76 are interconnected with tubular member 44 and armrest assembly 40, and are operable to pivotably mount armrest assembly 42 and to selectively fix the position of tubular member 44 relative to support section 38 of arm support member 34, to fix the height of armrest member 42 relative to seat 22.

Referring to FIGS. 3–6, tubular member 44 defines a lower tube section 78 and an upper mounting section 80 including an outwardly flared wall 82 terminating in an upper end 84. A forwardly facing slot 86 is formed in wall 82 and opens onto wall upper end 84. Mounting section 80 further includes a series of mounting bosses 88, each of which defines an upwardly open internal passage 90 extending in a direction parallel to the longitudinal axis of passage 46 defined by tube section 78 of tubular member 44. A series of reinforcing ribs 92 extend between wall 82 and each boss 88 for providing rigidity to bosses 88.

Figure 4:
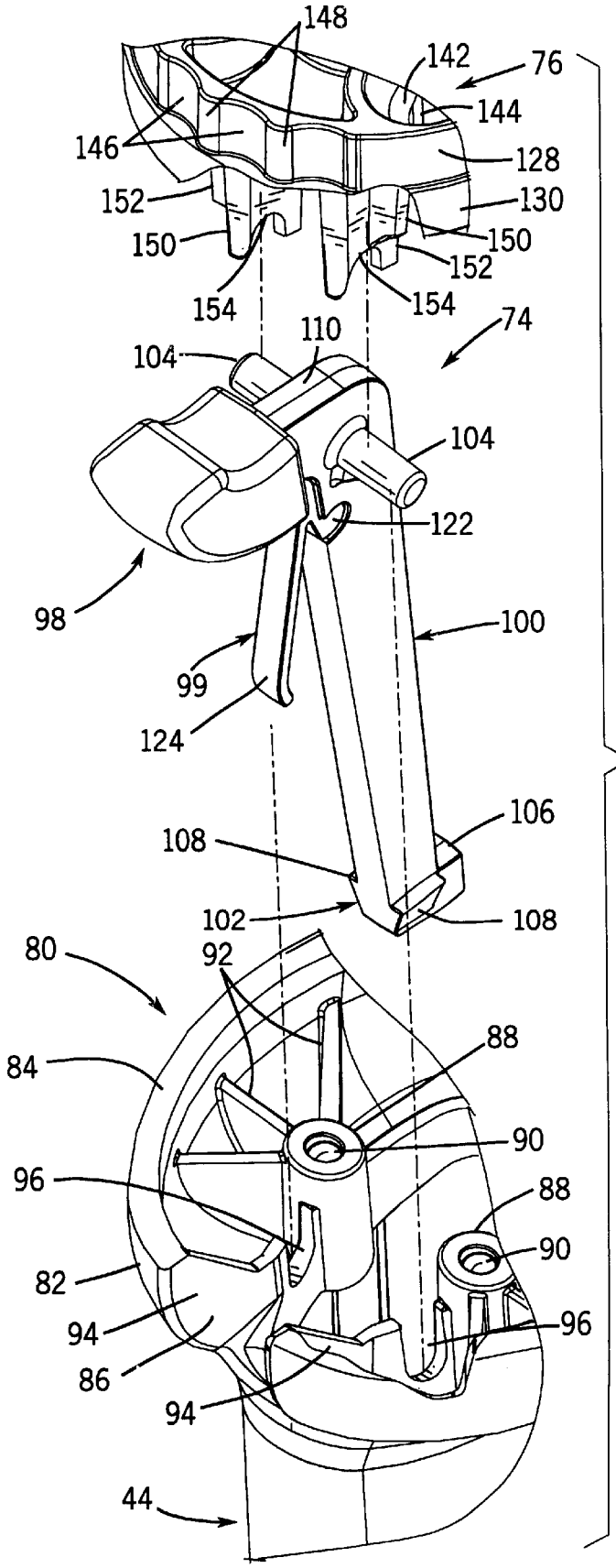
FIG. 4 is an enlarged partial isometric view illustrating the latch member and portions of the cap member and tubular member forming a part of the adjustable armrest assembly of FIG. 3.

As shown in FIG. 4, a pair of webs 94 extend rearwardly from mounting section wall 82, defining the sides of slot 86. Each web 94 is connected at its rearward end to one of bosses 88. An upwardly facing arcuate recess 96 is formed in each web 94 adjacent one of bosses 88.

Referring to FIG. 4, latch member 74 is generally in the form of an inverted L-shaped member, and includes an upper trigger section 98 and a depending latch arm 100 terminating in a lower engagement section 102. A pair of coaxial pivot pins 104 are formed integrally with latch arm 100, extending outwardly in opposite directions from side surfaces defined by latch arm 100. Engagement section 102 includes a protrusion 106 which extends rearwardly from a rear edge defined by latch arm 100. In addition, engagement section 102 includes a pair of tabs 108, each of which extends outwardly from a side surface defined by latch arm 100.

Figure 7:
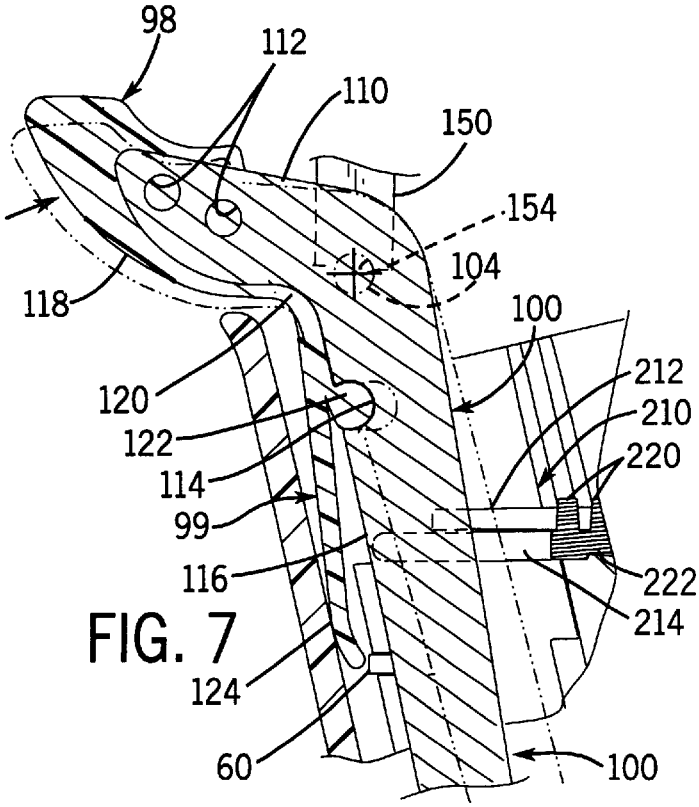
FIG. 7 is a partial section view illustrating movement of the latch member in the adjustable height arm assembly of FIG. 5.
Figure 8:
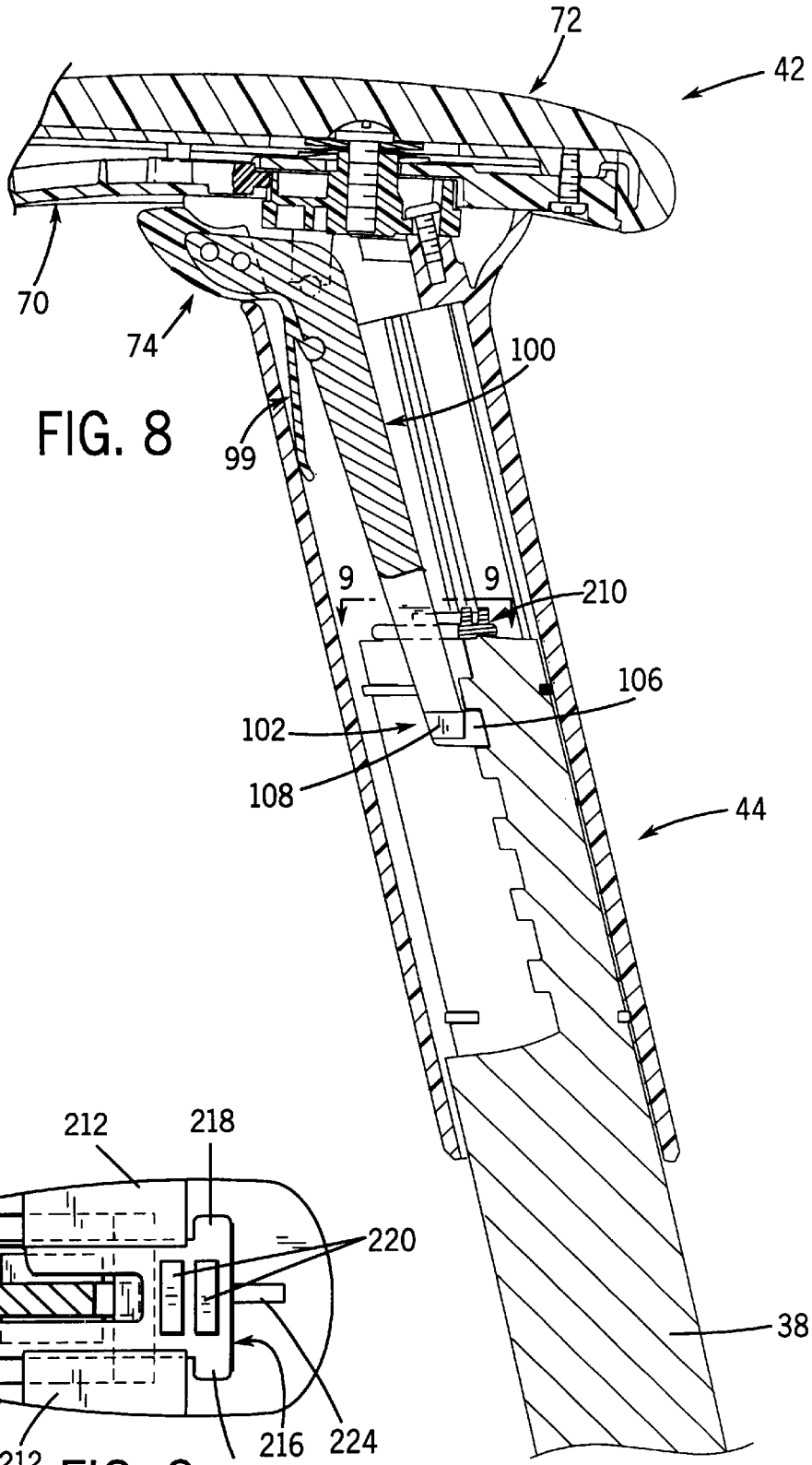
FIG. 8 is a view similar to FIG. 5, showing the armrest assembly in a raised position relative to the support member.

Referring to FIG. 7, latch arm 100 includes a forward extension 110 at its upper end, and a pair of openings 112 are formed in forward extension 110. In addition, a rearwardly extending recess 114 is formed in a front edge 116 defined by latch arm 100.

Trigger section 98 and spring member 99 are formed integrally with each other, and are overmolded onto latch arm 100 in a manner as is known. Trigger section 98 includes a downwardly facing curved engagement surface 118, and side areas which overlie the sides of forward extension 110. The material of trigger section 98 is received within openings 112 in latch arm forward extension 110, so as to securely interconnect trigger section 98 with latch arm 100. In addition, the material of trigger section 98 defines a connector section 120 which generally follows the contour of the underside of forward extension 110 and the upper forward area of latch arm 100. Connector section 120, in turn, is formed integrally with an anchor section 122 which is received within recess 114 formed in front edge 116 of latch arm 100, and with spring member 99 which extends outwardly from anchor section 122. Spring member 99 is oriented so as to extend forwardly at an angle relative to latch arm front edge 116, defining a forwardly facing engagement surface 124 toward its lower end.

Figure 6:
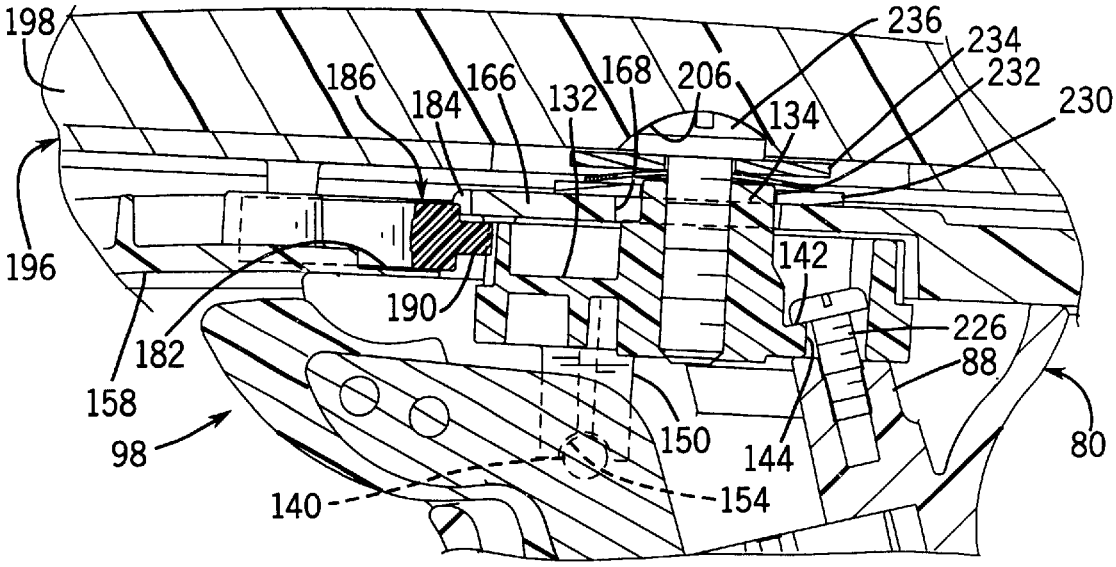
FIG. 6 is an enlarged partial section view, with reference to line 6—6 of FIG. 5.

Referring to FIGS. 3–6, cap member 76 is in the form of a generally disc-shaped member adapted for engagement with mounting section 80 at the upper end of internal passage 46. Cap member 76 includes a ring-like outer wall 126 having a stepped configuration, and including an upper section 128 and a lower section 130. Cap member 76 further includes a transverse inner wall 132, a central hub section 134 and a series of mounting bosses 136. Hub section 134 includes a central vertical passage 138 and an outer flat area 140. Referring to FIG. 6, each mounting boss 136 defines an angled seat 142 located at the upper end of a downwardly opening aperture 144.

Upper section 128 of cap member outer wall 126 includes a series of radially spaced, outwardly facing concave detent areas or indentations 146. A convex separation area 148 is located between each adjacent pair of indentations 146.

Cap member 76 further includes a pair of depending legs 150 which extend downwardly from inner wall 132. Each leg 150 includes a reinforcing rib 152, and defines a lower end having a downwardly facing arcuate recess 154.

As noted previously, armrest member 42 includes base section 70 and arm cap 72. Referring to FIGS. 3, 5, 6 and 10, base section 70 includes a bottom wall 158 and an upstanding outer wall 160 which is generally oval in shape. A series of ribs 162 are formed integrally with bottom wall 158 and outer wall 160. Base section 70 further includes a series of mounting bosses 164 which extend upwardly from bottom wall 158 and are interconnected with outer wall 160 via ribs 162.

Base section 70 has a raised circular plate section 166 formed with a central circular opening 168. A sidewall 170 extends between and interconnects plate section 166 and bottom wall 158. A series of radial ribs 172 extend outwardly from side wall 170 and are interconnected with outer wall 160.

An opening 174 is located between the forward area of plate section 166 and bottom wall 158. A rib 176 extends outwardly from side wall 170 at each end of opening 174, and a retainer boss 180 is located at the outer end of each rib 176. Each retainer boss 180 is generally C-shaped and opens in a rearward direction. A slot 182 is formed in bottom wall 158, extending forwardly from opening 174. A notch 184 is formed in the outer edge of plate section 166 at opening 174, and is in alignment with slot 182.

A resilient engagement member, in the form of a spring member shown generally at 186, is engaged with plate section 70. Spring member 186 is arcuate in shape, and includes a pair of enlarged end sections 188. The curvature of spring member 186 is such that spring member 186 is convex in a rearward direction, i.e. the body portion of spring member 186 between end sections 188 is curved outwardly in a rearward direction. An engagement area in the form of a rearwardly projecting protrusion 190 extends from the rearward edge of spring member 186, and is located centrally between end sections 188. Upper and lower tabs 192, 194, respectively, extend from the upper and lower surfaces, respectively, of spring member 186. Tabs 192, 194 are located in alignment with rearward protrusion 190.

Referring to FIG. 5, arm cap 72 includes a mounting plate 196 to which an arm pad 198 is secured in a known manner. Mounting plate 196 includes an outer peripheral lip 200 received within a peripheral outer groove formed in arm pad 198, and a series of mounting bosses 202. An opening 204 is formed in mounting plate 196, and a downwardly facing recess 206 is formed in arm pad 198 within the area defined by opening 204.

In assembly, a retainer member 210 (FIGS. 3, 5 and 7) is adapted for placement between a pair of upstanding members 212 located at the upper end of support section 38. Retainer member 210 is generally U-shaped, including a pair of spaced apart legs 214 and a bight section 216 extending therebetween. Bight section 216 includes outwardly extending ears 218, and a pair of upstanding engagement tabs 220. A slot 222 (FIG. 7) is formed in the underside of bight section 216.

Figure 9:
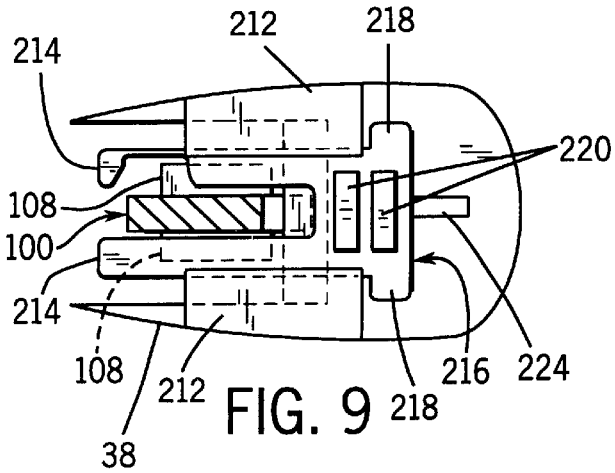
FIG. 9 is a partial section view, with reference to line 9—9 of FIG. 8.
Figure 10:
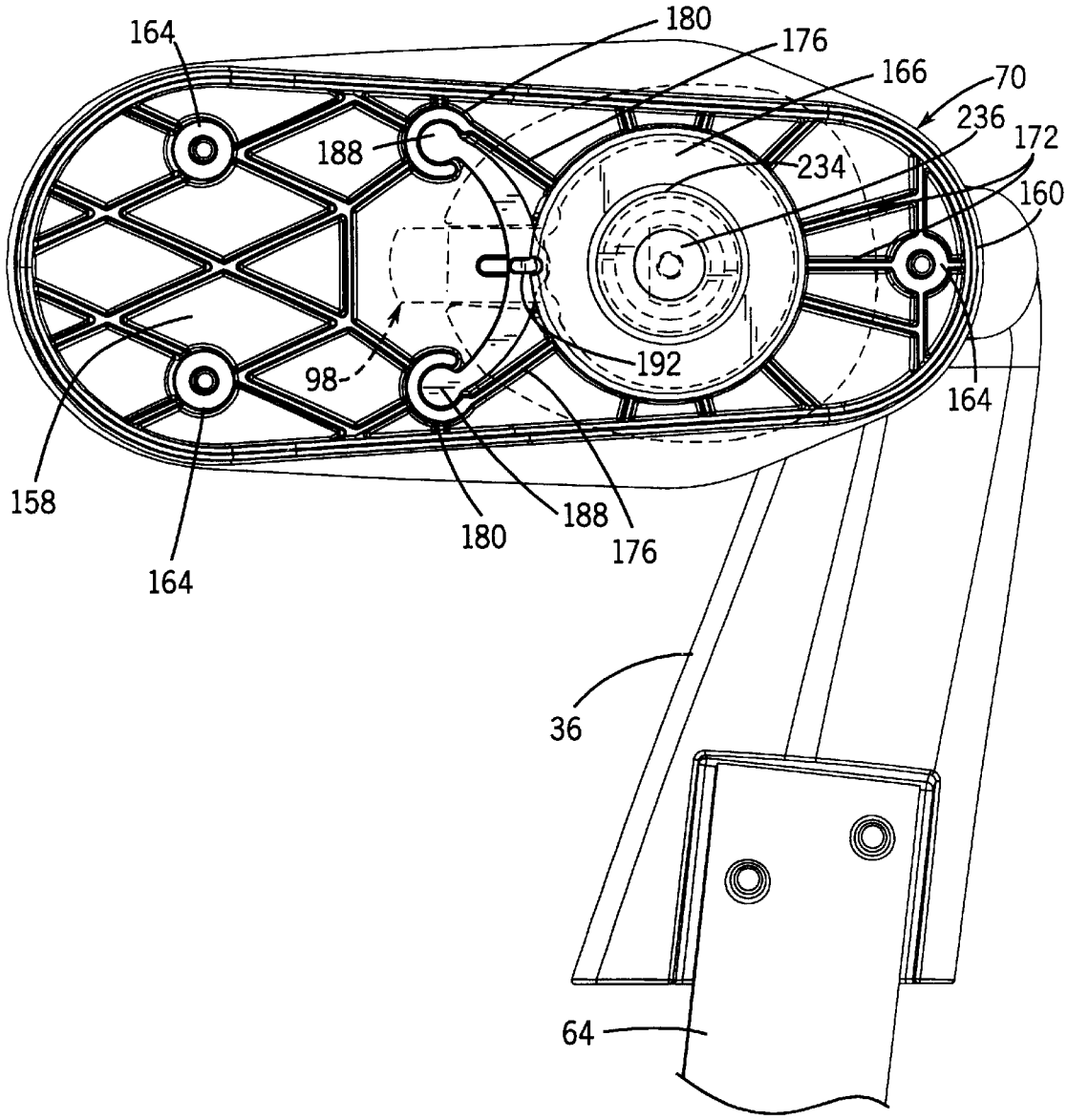
FIG. 10 is a top plan view of the armrest assembly of FIG. 3, in which the arm cap portion of the armrest member is removed and illustrating a detent arrangement for selectively maintaining the armrest member in a predetermined angular orientation relative to the tubular member of the armrest assembly.
Figure 11:
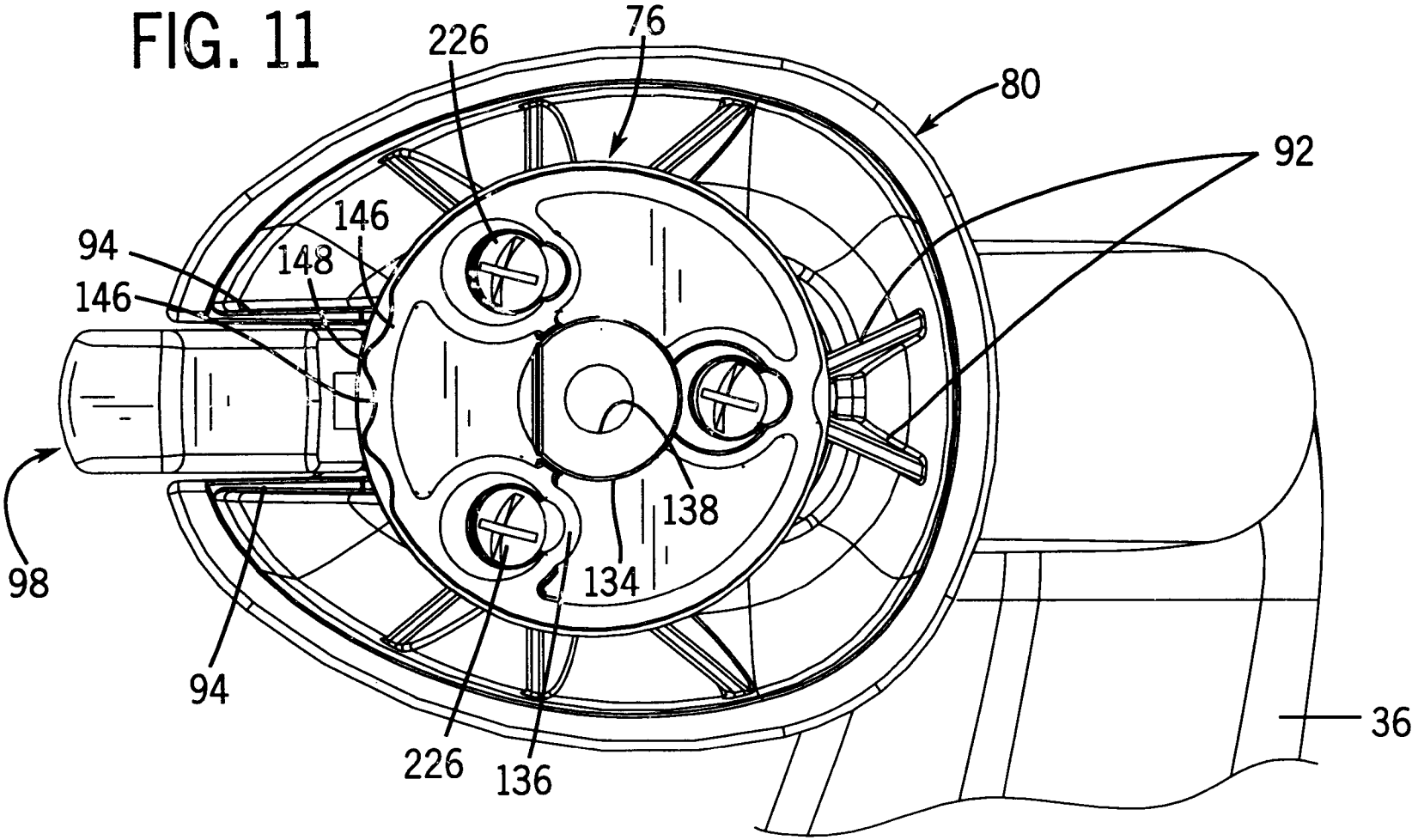
FIG. 11 is a view similar to FIG. 10, in which the armrest member is removed and illustrating the upper end of the tubular member and cap member to which the armrest member is mounted.
Figure 12:
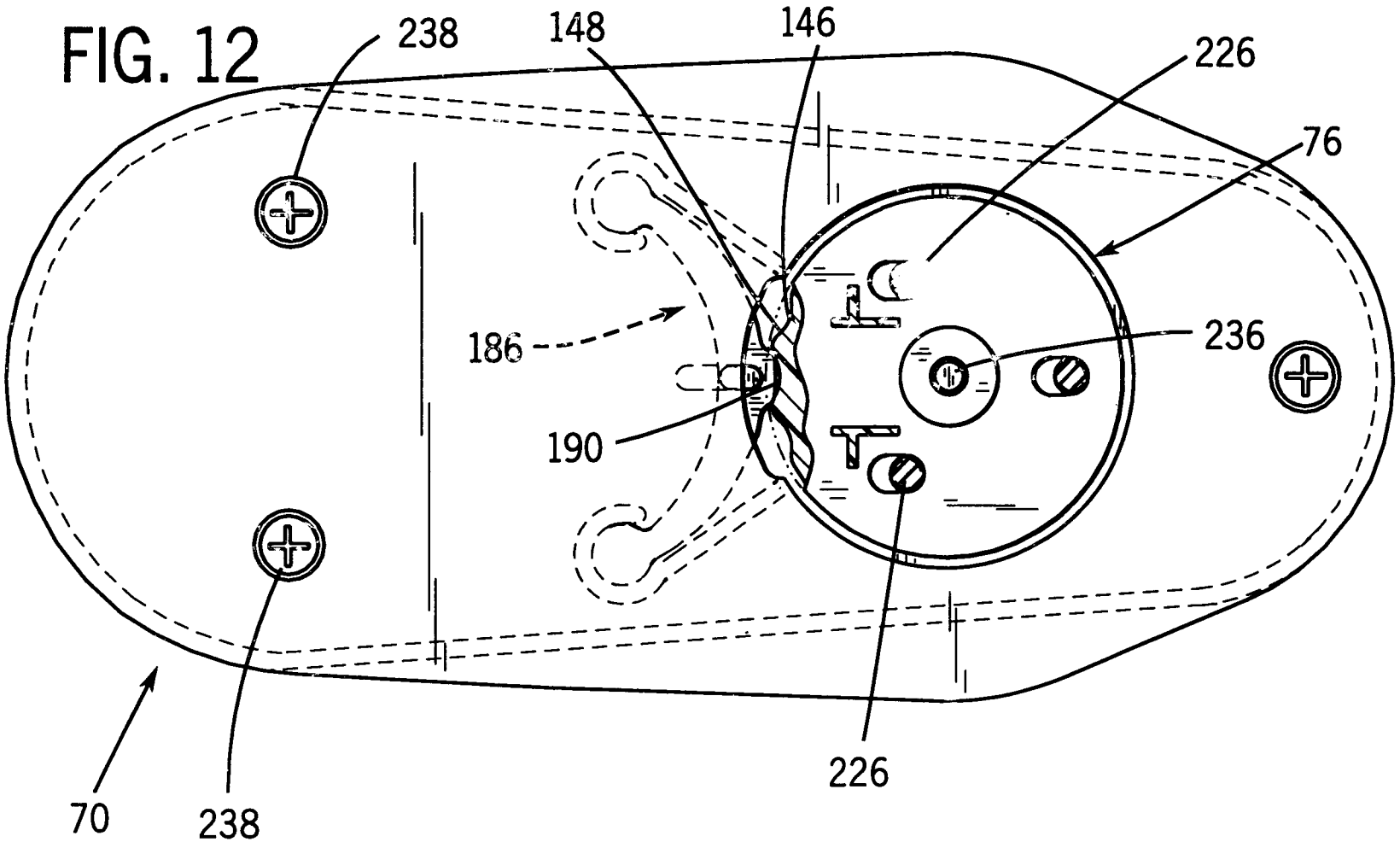
FIG. 12 is a bottom plan view, with reference to line 12—12 of FIG. 5, illustrating the armrest member and cap member and the detent arrangement for selectively maintaining the armrest member in a predetermined horizontal orientation.

Upstanding members 212 define a pair of facing grooves which are adapted to receive retainer member legs 214. A ramp 224 is formed in the upper surface of support section 38. Retainer member 216 is initially in a nonengaging position, in which legs 214 are positioned between upstanding members 212, with each leg 214 being engaged within only the rearward area of the groove defined by one of upstanding members 212. With retainer member 210 in this position, tubular member 44 is telescopingly engaged with support section 38 such that support section 38 is received within internal passage 46 defined by tubular member 44. Tubular member 44 is lowered onto support section 38 to the fullest extent possible, and latch member 74 is then inserted through the open upper end of tubular member 44 defined by internal passage 46 such that engagement section 102 is inserted into channel 48 defined by support section 38. The initial rearward positioning of retainer member 210 enables engagement section 102, including tabs 108, to pass into and through the open upper end of channel 48. With engagement section 102 inserted into channel 48, retainer member 210 is moved forwardly to an engaging position as illustrated in FIG. 9. To accomplish this, the tip of a tool such as a screwdriver is inserted into the space between engagement tabs 220, and a forward force is exerted on the tool so as to move engagement member 210 forwardly, wherein legs 214 slide within the facing grooves defined by upstanding members 212. Retainer member 210 is moved forwardly to the position as shown in FIG. 9, in which each ear 218 engages the rear surface of one of upstanding members 212. In this position, ramp 224 is received within slot 222, to provide a detent for maintaining retainer member 210 in its forward position.

With retainer member 210 positioned as described, legs 214 of retainer member 210 are located above the side portions of channel 48 formed in support section 38. The width of the space between legs 214 is sufficient to receive latch arm 100 therebetween. Legs 214 of retainer member 210 are located so as to engage tabs 108 of latch arm engagement section 102 when latch member 74 is moved upwardly to an extended position relative to support section 38.

Once latch arm 100 and retainer member 210 are positioned as described, such that the lower end area of latch arm 100 and engagement section 102 are positioned within channel 48, each pivot pin 104 of latch member 74 is placed within one of upwardly facing arcuate recesses 96, which are formed in web 94. Cap member 76 is then positioned within mounting section 80 of tubular member 44 such that each downwardly facing recess 154 formed in legs 150 engages the upper portion of one of pivot pins 104. In addition, cap member 76 is positioned such that mounting bosses 136 of cap member 76 are in alignment with bosses 88 provided in mounting section 80 of tubular member 44. Each seat 142 of a mounting boss 136 is oriented so as to be substantially perpendicular to the longitudinal axis of the passage 90 formed in boss 88 with which mounting boss 136 is engaged, and fasteners such as screws 226 (FIGS. 3, 6) extend through apertures 144 of mounting bosses 136 into engagement with passages 90 of bosses 88. When cap member 76 is connected to mounting section 80 in this manner, the upper end of each boss 88 engages a downwardly facing surface defined by each mounting boss 136, such that cap member 76 is securely engaged with tubular member 44. Recesses 154 in cap member legs 150 cooperate with recesses 96 in webs 94 to define a pivotable mounting structure engageable with pivot pins 104 so as to mount latch member 74 to tubular member 44, for pivoting movement about a pivot axis defined by pivot pins 104. When latch member 74 is mounted to tubular member 44, spring member 99 engages the inner surface, shown at 228, defined by the forward wall of tubular member 44 so as to bias latch member 74 in a counterclockwise direction, i.e. in a direction in which engagement section 102 of latch arm 100 is urged toward end wall 52 and teeth 54 defined by channel 48 in support section 38.

After cap member 76 is assembled to tubular member 44 in this manner, base section 70 of armrest member 42 is mounted to cap member 76 for pivoting movement in a substantially horizontal plane. This is carried out by placing base section 70 over cap member 76 such that hub section 134 of cap member 76 extends through opening 168 in plate section 166. In this position, such that the upper surface of cap member upper wall section 128 engages the underside of plate section 166, and the upper surfaces of mounting bosses 136 likewise engage the underside of plate section 166. A washer 230 is then engaged with hub section 134. Washer 230 has an opening corresponding to the shape of the upper area of hub section 134, i.e. a flat edge which is configured to receive and engage flat area 140 of hub section 134. A spring washer 232 is then placed over hub section 134 into engagement with lower washer 230, and an upper washer 234 is engaged with the top surface of hub section 134. A threaded fastener 236 is then inserted through the opening of washer 234 into engagement with threaded passage 138 of hub section 134, to mount base section 70 to tubular member 44 through cap member 76. Fastener 236 functions as a pivot pin, such that the longitudinal axis of fastener 236 defines the axis about which base section 70 is pivotable relative to tubular member 44. In the illustrated embodiment, the axis of fastener 236 is substantially vertical, so as to enable armrest member 42 to be pivoted in a substantially horizontal plane.

Spring washer 232 bears between lower and upper washers 230, 234, respectively, and rides on lower washer 230 during pivoting movement of base section 70 relative to cap member 76. With this construction, spring washer 232 is operable to relieve stress on fastener 236 when armrest member 42 is pivoted.

Once base section 70 is assembled to cap member 76 as described, arm cap 72 is mounted to base section 70 using fasteners such as screws 238 which extend through mounting bosses 164 into engagement with passages in mounting bosses 202 of mounting plate 196. With arm cap 72 engaged with base section 70 in this manner, the head of fastener 236 is received within recess 206 defined by arm pad 198.

Spring member 186 is assembled to base section 70 and captured between bottom wall 158 of base section 70 and mounting plate 196 of arm cap 72. Spring member 186 is constructed such that protrusion 190 extends into opening 174 located below plate section 166. Indentations 146 in upper wall section 128 of cap member 76 are positioned so as to be exposed through opening 176, and protrusion 190 extends into engagement with one of indentations 146.

In operation, armrest assembly 40 functions as follows to provide both height adjustment of armrest member 42 as well as adjustment in the lateral position of armrest member 42. As shown in solid lines in FIG. 5, protrusion 106 defined by engagement section 102 of latch arm 100 is received within one of indentations 56, to fix the position of armrest member 42 relative to support section 38 and thereby relative to seat 22. To adjust the vertical position of armrest member 42, the user manually engages engagement surface 118 defined by trigger section 98, and applies an upward force to trigger section 98 so as to move latch member 74 from its engaged position, (shown in solid lines in FIG. 5 and phantom lines in FIG. 7) to its disengaged position (shown in phantom lines in FIG. 5 and in solid lines in FIG. 7) by pivoting latch member 74 about pivot pins 104. Spring member 99 resists such movement of latch member 74, and the user continues to exert upward pressure on engagement surface 118 to maintain latch member 74 in its disengaged position, in which protrusion 106 is moved out of indentation 56. The user then adjusts the vertical position of tubular member 44 relative to support section 38 by applying either an upward or a downward force on armrest member 42. When the desired position is attained, the user releases engagement of engagement surface 118, and latch member 74 returns to its engaged position under the influence of spring member 99. Protrusion 106 is received within another of indentations 56, so as to fix the position of armrest member 42. In the event protrusion 106 engages one of teeth 54 between indentations 56, the user exerts either an upward or a downward force on armrest member 42 so as to move tubular member 44 either upwardly or downwardly, until protrusion 106 is in alignment with one of indentations 56 and is moved into the indentation 56 under the influence of spring member 99.

To adjust the position of armrest member 42 in a horizontal plane, as shown in FIGS. 12-15, the user exerts a lateral force on armrest member 42 at a location spaced from the pivot axis defined by fastener 236. This results in rotation of armrest member 42 about the axis defined by fastener 236. During such rotation of armrest member 42, protrusion 190 on spring member 186 passes out of one indentation 146 into another. In doing so, protrusion 190 of spring member 186 passes over a separation area 148 between indentations 146, and spring member 186 flexes forwardly to accommodate such movement of protrusion 190. Protrusion 190 is then seated within the next one of indentations 146, to provide a detent tending to maintain armrest member 42 in a predetermined angular orientation. Any number and size of indentations 146 may be employed so as to selectively retain armrest member 42 in a predetermined angular orientation. Representatively, one of indentations 146 positions armrest member 72 in a front-rear direction, and other indentations 146 function to position armrest member 42 in various inward and outward positions. Protrusion 190 and indentations 146 provide a click-type detent arrangement for selectively maintaining armrest member 42 in certain predetermined angular orientations.

In addition, it should be understood that armrest member 42 may be rotated 360° about fastener 36 and hub section 134, and is not limited to the positions defined by indentations 146. During such movement, protrusion 190 engages and rides on upper wall section 128, and spring member 186 flexes inwardly.

In the event the user attempts to raise armrest assembly 40 above a predetermined extended position relative to support section 38, tabs 108 provided on engagement section 102 of latch arm 100 engage legs 214 of retainer member 210, to prevent armrest assembly 40 from being removed from support section 38. If it is necessary to remove armrest assembly 40, the user reverses the steps described above in assembly, resulting in rearward movement of retainer member 210 to a position in which legs 214 allow tabs 108 to pass upwardly out of the open end of channel 48.

The invention thus provides an armrest assembly wherein the armrest member can be adjusted both in height and in horizontal position. The invention incorporates a number of unique features accomplishing such dual movement of the armrest member and facilitating ease of assembly and reliable operation.

Various alternatives and embodiments are contemplated as being within the scope of the following claims particularly pointing out and distinctly claiming the subject matter regarded as the invention.

We claim:

1. An arm adjustment mechanism for a chair having a seat and a back, comprising:

a support member extending upwardly from the seat adjacent a side of the seat, wherein the support member includes a channel defining a series of spaced engagement areas;

an armrest assembly including an armrest member and a depending tubular member, wherein the tubular member defines an internal passage adapted to receive the support member for slidably mounting the tubular member to the support member;

a latch member pivotably mounted to the armrest assembly, wherein the latch member includes an engagement section and a trigger section spaced from the engagement section and adapted for manual engagement by a user for pivoting the latch member from an engaged position to a disengaged position, wherein the latch member in its engaged position is positioned such that the engagement section is received within one of the engagement areas for maintaining the position of the tubular member relative to the support member to fix the height of the armrest member, and wherein the latch member in its disengaged position is positioned such that the engagement section is moved out of the engagement area for enabling movement of the tubular member relative to the support member to adjust the height of the armrest member, wherein the latch member includes a pivot pin arrangement defining a pivot axis about which the latch member is pivotable, wherein the pivot pin arrangement is received within a first pivot support area defined by the tubular member;

a cap member engaged with the tubular member, wherein the cap member includes a second pivot support area engaged with the pivot pin arrangement, wherein the first and second pivot support areas cooperate to capture the pivot pin arrangement of the latch member for pivotably mounting the latch member to the armrest assembly;

a pivotable mounting arrangement interposed between the cap member and the armrest member for providing pivoting movement of the armrest member about a substantially vertical pivot axis;

a detent arrangement for selectively fixing the position of the armrest member relative to the support member, comprising a series of laterally facing detent surfaces on the cap member and a resilient engagement member provided on the armrest member, wherein the engagement member is selectively engageable with the detent surfaces to releasably maintain the armrest member in a predetermined horizontal position relative to the support member;

a biasing member formed integrally with the trigger section of the latch member, wherein the biasing member is engageable with an inner wall defined by the tubular member for biasing the latch member toward the engaged position; and a retainer arrangement for maintaining the support member within the passage of the tubular member, comprising a retainer member engaged with the support member and including an opening therethrough, and engagement structure provided on the latch member at a location spaced from the trigger section, wherein the latch member extends through the opening of the retainer member and wherein the engagement structure provided on the latch member is engageable with the retainer member upon movement of the tubular member to a predetermined extended position relative to the support member, wherein engagement of the engagement structure with the retainer member is operable to maintain at least a portion of the support member within the internal passage defined by the tubular member.

2. An arm assembly for a chair having a seat and a back, comprising:

a support member extending upwardly from the seat adjacent a side of the seat, wherein the support member includes a series of spaced engagement areas;

an armrest assembly including an armrest member and a depending tubular member, wherein the tubular member defines an internal passage adapted to receive the support member for slidably mounting the tubular member to the support member;

a latch member pivotably mounted to the armrest assembly, wherein the latch member includes an engagement section and a trigger section spaced from the engagement section and adapted for manual engagement by a user for pivoting the latch member from an engaged position to a disengaged position, wherein the latch member in its engaged position is positioned such that the engagement section is received within one of the engagement areas for maintaining the position of the tubular member relative to the support member to fix the height of the armrest member, and wherein the latch member in its disengaged position is positioned such that the engagement section is moved out of the engagement area for enabling movement of the tubular member relative to the support member to adjust the height of the armrest member, wherein the latch member includes a pivot pin arrangement defining a pivot axis about which the latch member is pivotable, wherein the pivot pin arrangement is received within a first pivot support area defined by the tubular member;

a cap member engaged with the tubular member, wherein the cap member includes a second pivot support area engaged with the pivot pin arrangement, wherein the first and second pivot support areas cooperate to capture the pivot pin arrangement of the latch member and to pivotably mount the latch member to the armrest assembly; and a biasing member for biasing the latch member toward its engaged position.

3. The arm assembly of claim 2, wherein the latch member defines a lower end including the engagement section and an upper end spaced therefrom, wherein the trigger section is located at the upper end of the latch member, and wherein the pivot pin arrangement of the latch member comprises a pair of pin members extending outwardly in opposite directions from the upper end of the latch member.

4. The arm assembly of claim 3, wherein the first pivot support area defined by the tubular member comprises structure defining a pair of upwardly facing arcuate recesses located toward an upper end defined by the tubular member, wherein each arcuate recess is adapted to receive one of the pin members.

5. The arm assembly of claim 4, wherein the second pivot support area defined by the cap member comprises structure defining a pair of downwardly facing arcuate recesses provided on the cap member, wherein each downwardly facing arcuate recess is adapted to receive one of the pin members.

6. The arm assembly of claim 5, wherein the tubular member includes an upper mounting portion, wherein the cap member is secured to the upper mounting portion and wherein the upper mounting portion includes the structure defining the pair of upwardly facing arcuate recesses.

7. The arm assembly of claim 6, wherein the upper mounting portion of the tubular member includes a plurality of bosses with which the cap member is engaged, and wherein the cap member is engaged with the tubular member by means of a plurality of fasteners, each of which interconnects the cap member with one of the plurality of bosses.

8. In an adjustable height arm for a chair including an upwardly extending support member, an armrest assembly including an armrest member and a depending tubular member defining an internal passage adapted to slidably receive the support member for adjusting the height of the armrest member relative to the support member, and an engagement arrangement interposed between the tubular member and the support member for selectively fixing the height of the armrest member, the improvement comprising a cap member secured to the tubular member toward an upper end defined by the tubular member, wherein the armrest member is pivotably mounted to the cap member for pivoting movement about a substantially vertical pivot axis to move the armrest in a substantially horizontal plane, and a detent arrangement interposed between the armrest member and the cap member for selectively maintaining the armrest member in a predetermined horizontal position relative to the tubular member.

9. The improvement of claim 8, wherein the engagement arrangement interposed between the tubular member and the support member includes a latch member, and wherein the latch member, the catch member and the tubular member include cooperating mounting structure for pivotably mounting the latch member to the tubular member for movement between an engaged position and a disengaged position.

10. The improvement of claim 8, wherein the armrest member is pivotably mounted to the cap member via a substantially vertically oriented pivot member extending between and interconnecting the armrest member and the cap member.

11. The improvement of claim 10, wherein the pivot member comprises a threaded fastener engaged with the armrest member and extending into a threaded passage in the cap member.

12. The improvement of claim 8, wherein the detent arrangement comprises a series of laterally facing detent areas provided on the cap member, and a resilient engagement member mounted to the armrest member, wherein the resilient engagement member is selectively engageable with one of the laterally facing detent areas for releasably maintaining the armrest member in a predetermined horizontal position relative to the tubular member.

13. The improvement of claim 12, wherein the resilient engagement member comprises a spring member having a pair of spaced ends and an engagement area located between the spaced ends, wherein the engagement area is selectively engageable with one of the laterally facing detent areas of the cap member.

14. The improvement of claim 13, wherein the spaced ends of the spring member are fixedly engaged with the armrest member, wherein movement of the armrest member relative to the tubular member causes the spring member to deflect between the spaced ends by movement of the engagement area of the spring member over the laterally facing detent areas provided on the cap member.

15. The improvement of claim 14, wherein the armrest member includes a base member and an arm cap removably mounted to the base member, wherein the ends of the spring member are secured to the base member and wherein the base member is located between the cap member and the tubular member.

16. An arm assembly for a chair having a seat and a back, comprising:

a support member extending upwardly from the seat adjacent a side of the seat, wherein the support member includes a series of spaced engagement areas;

an armrest assembly including an armrest member and a depending tubular member, wherein the tubular member defines an internal passage adapted to receive the support member for slidably mounting the tubular member to the support member;

a latch member including an engagement section and a trigger section spaced from the engagement section and adapted for manual engagement by a user;

a cap member engaged with the tubular member over the internal passage of the tubular member, wherein the cap member, the tubular member and the latch member include cooperating pivotable mounting structure for pivotably mounting the latch member to the tubular member, wherein the latch member is movable from an engaged position to a disengaged position by manual movement of the trigger section by a user, wherein the latch member in its engaged position is positioned such that the engagement section is engaged with one of the support member engagement areas to fix the vertical position of the armrest relative to the support member, and wherein the latch member in its disengaged position is positioned such that the engagement section is moved out of the engagement area to enable movement of the tubular member relative to the support member to adjust the height of the armrest member; and a pivotable mounting arrangement interposed between the armrest and the cap member for pivotably mounting the armrest to the cap member for movement about a substantially vertical pivot axis.

17. The arm assembly of claim 16, wherein the latch member defines an upper end and a lower end, wherein the engagement section is located toward the lower end of the latch member and wherein a pair of pivot pins extend outwardly from the latch member toward the upper end of the latch member, wherein the cap member and the tubular member include recess structure which receives the pivot pins and which functions to pivotably mount the latch member when the cap member is engaged with the tubular member.

18. The arm assembly of claim 17, wherein the cap member includes a substantially vertical passage and wherein a pivot member is engaged with the armrest member and extends into the substantially vertical passage for pivotably mounting the armrest member to the cap member, wherein the pivot member defines the substantially vertical pivot axis about which the armrest member is pivotable.

19. The arm assembly of claim 18, wherein the pivot member comprises a threaded fastener having a head engaged with the armrest member and a threaded shank engaged with threads located in the substantially vertical passage of the cap member.

20. The arm assembly of claim 19, further comprising a first disc member engaged with the armrest member, a second disc member engaged with the head of the threaded fastener, and a spring disc member located between the first and second disc members for facilitating movement of the armrest member relative to the cap member.

21. The arm assembly of claim 16, further comprising a series of laterally facing detent surfaces provided on the cap member, and a resilient engagement member mounted to the armrest member, wherein the resilient engagement member is selectively engageable with one of the laterally facing detent surfaces for releasably maintaining the armrest member in a predetermined horizontal position relative to the support member.

22. An arm assembly for a chair having a seat and a back, comprising:

a support member extending upwardly from the seat adjacent a side of the seat, wherein the support member defines an upper end;

an armrest member pivotably mounted to the support member for movement about a substantially vertical pivot axis; and a detent arrangement for selectively fixing the position of the armrest member relative to the support member, comprising a series of laterally facing detent surfaces associated with one of the support member and the armrest member, and a resilient engagement member mounted to the other of the support member and the armrest member, wherein the engagement member is selectively engageable with one of the laterally facing detent surfaces, wherein engagement of the engagement member with one of the laterally facing detent surfaces is operable to releasably maintain the armrest member in a predetermined horizontal position relative to the support member.

23. The arm assembly of claim 22, wherein the armrest member is engaged with a depending tubular member defining an internal passage within which the support member is received for slidably mounting the tubular member and armrest member relative to the support member.

24. The arm assembly of claim 23, further comprising a cap member engaged with the depending tubular member toward an upper end defined by the tubular member.

25. The arm assembly of claim 24, wherein the series of laterally facing detent surfaces are located on the cap member and wherein the resilient engagement member is mounted to the armrest member.

26. The arm assembly of claim 25, wherein the laterally facing detent surfaces comprise a series of recesses defined by the cap member, and wherein the resilient engagement member includes a protrusion engageable within the series of recesses.

27. The arm assembly of claim 26, wherein the resilient engagement member comprises a spring member mounted to the armrest member, wherein the protrusion is located on the spring member.

28. The arm assembly of claim 27, wherein the spring member defines a pair of spaced ends, each of which is fixedly mounted to the armrest member, and wherein the protrusion is located on a central area of the spring member between the spaced ends which is deflectable upon movement of the armrest member by movement of the protrusion from one of the recesses to another of the recesses.

29. An arm assembly for a chair having a seat and a back, comprising:

a support member extending upwardly from the seat adjacent a side of the seat, wherein the support member includes a series of spaced engagement areas;

an armrest assembly including an armrest member and a depending tubular member, wherein the tubular member defines an internal passage adapted to receive the support member for slidably mounting the tubular member to the support member;

a latch member movably mounted to the armrest assembly, wherein the latch member includes an engagement section and a trigger section spaced from the engagement section and adapted for manual engagement by a user for moving the latch member from an engaged position to a disengaged position, wherein the latch member in its engaged position is positioned such that the engagement section is received within one of the engagement areas for maintaining the position of the tubular member relative to the support member to fix the height of the armrest member, and wherein the latch member in its disengaged position is positioned such that the engagement section is moved out of the engagement area for enabling movement of the tubular member to adjust the height of the armrest member;

a biasing member for biasing the latch member toward its engaged position; and a retainer arrangement for maintaining the support member within the passage of the tubular member, comprising a retainer member engaged with the support member, and engagement structure provided on the latch member and engageable with the retainer member when the tubular member is moved to a predetermined extended position relative to the support member.

30. The arm assembly of claim 29, wherein the support member defines a channel within which the series of spaced engagement areas are located.

31. The arm assembly of claim 30, wherein the retainer member is constructed and arranged such that at least a portion of the retainer member is disposed within the channel and is engageable with the engagement structure provided on the latch member.

32. The arm assembly of claim 31, wherein the retainer member is engaged with an upper end defined by the support member.

33. The arm assembly of claim 29, wherein the retainer member is mounted to the support member for movement between a nonengaging position and an engaging position, wherein the retainer member is constructed and arranged to allow the engagement structure provided on the latch member to pass through the retainer member when the retainer member is in the nonengaging position, to a position in which the engagement section of the latch member is engageable with the series of spaced engagement areas of the support member, and to engage the engagement structure provided on the latch member when the retainer member is in the engaging position to maintain the engagement section of the latch member in a location adjacent the spaced engagement areas of the support member.

34. The arm assembly of claim 33, wherein the armrest assembly is mounted to the support member by first placing the retainer member in the nonengaging position and then slidably inserting the support member into the internal passage of the tubular member and passing the engagement structure of the latch member to a position in which the engagement section of the latch member is engageable with the series of spaced engagement areas of the support member, and thereafter moving the retainer member to the engaging position to maintain the latch member in engagement with the support member.

35. The arm assembly of claim 34, further comprising a cap member engageable with the latch member and the tubular member for maintaining the latch member in engagement with the tubular member.

36. The arm assembly of claim 35, wherein the cap member, the tubular member and the latch member include structure for pivotably mounting the latch member relative to the tubular member when the cap member is engaged with the latch member and the tubular member.

37. In an arm height adjustment mechanism including an upwardly extending support member having a series of spaced notches, an armrest assembly including an armrest and a depending tubular member defining an internal passage adapted to receive the support member for slidably mounting the tubular member to the support member, and a latch member movably mounted to the armrest assembly, wherein the latch member includes an engagement section adapted for selective engagement with one of the spaced notches for selectively fixing the position of the tubular member relative to the support member to selectively fix the height of the armrest assembly, the improvement comprising an integral trigger and spring member interconnected with the latch member, wherein the trigger and spring member includes a trigger section manually engageable by a user for moving the latch member to a disengaged position in which the engagement member is disengaged from the notches, and a spring section engageable with an inner wall defined by the tubular member for biasing the latch member toward an engaged position in which the engagement member is engaged with one of the spaced notches.

38. The improvement of claim 37, wherein the integral trigger and spring member is interconnected with the latch member by an overmolding process.

39. The improvement of claim 38, wherein the latch member includes an upper area having one or more openings, and wherein the material of the integral trigger and spring member is received within the one or more openings.

40. The improvement of claim 39, wherein the one or more openings include at least one opening in the latch member adjacent the trigger section, and at least one opening in an edge defined by the latch member adjacent the spring section.

41. The improvement of claim 37, wherein the latch member is formed with integral pin structure for pivotably mounting the latch member relative to the tubular member.

42. The improvement of claim 41, further comprising a cap member engageable toward an upper end defined by the tubular member, wherein the cap member and the tubular member define cooperating pivotable mounting structure for engagement with the integral pin structure of the latch member to pivotably mount the latch member to the tubular member.

* * * * *